United States Patent [19]

Coyte

[11] Patent Number: 4,503,868

[45] Date of Patent: Mar. 12, 1985

[54] CIGARETTE MANUFACTURE

[75] Inventor: Raymond G. Coyte, High Wycombe, England

[73] Assignee: Molins PLC, London, England

[21] Appl. No.: 378,736

[22] Filed: May 17, 1982

[30] Foreign Application Priority Data

May 20, 1981 [GB] United Kingdom ..... 8115456

[51] Int. Cl.[3] ..... A24C 5/00; A24C 5/34; A24C 5/345

[52] U.S. Cl. ..... 131/282; 131/907; 131/908; 131/910

[58] Field of Search ..... 131/280, 281, 282, 283, 131/94, 95, 906, 907, 908, 910

[56] References Cited

U.S. PATENT DOCUMENTS 4,326,542 4/1982 Laszlo et al. ..... 131/608

4,403,619 9/1983 Dahlgrun ..... 131/908

4,403,620 9/1983 Joseph et al. ..... 131/908

*Primary Examiner*—V. Millin

*Attorney, Agent, or Firm*—Antonelli, Terry & Wands

[57] ABSTRACT

Apparatus for controlling the timing of control signals concerning operations on conveyed cigarettes or other articles of the cigarette industry comprising means for generating a first control signal; means for measuring the speed of transport of the cigarettes; processing means arranged to receive a signal representing the measured speed of transport, to receive the first control signal and to generate a second control signal which is transmitted to an operating device after a delay dependent upon the signal representing the measured speed of transport and upon the characteristics and position of the operating device.

8 Claims, 1 Drawing Figure

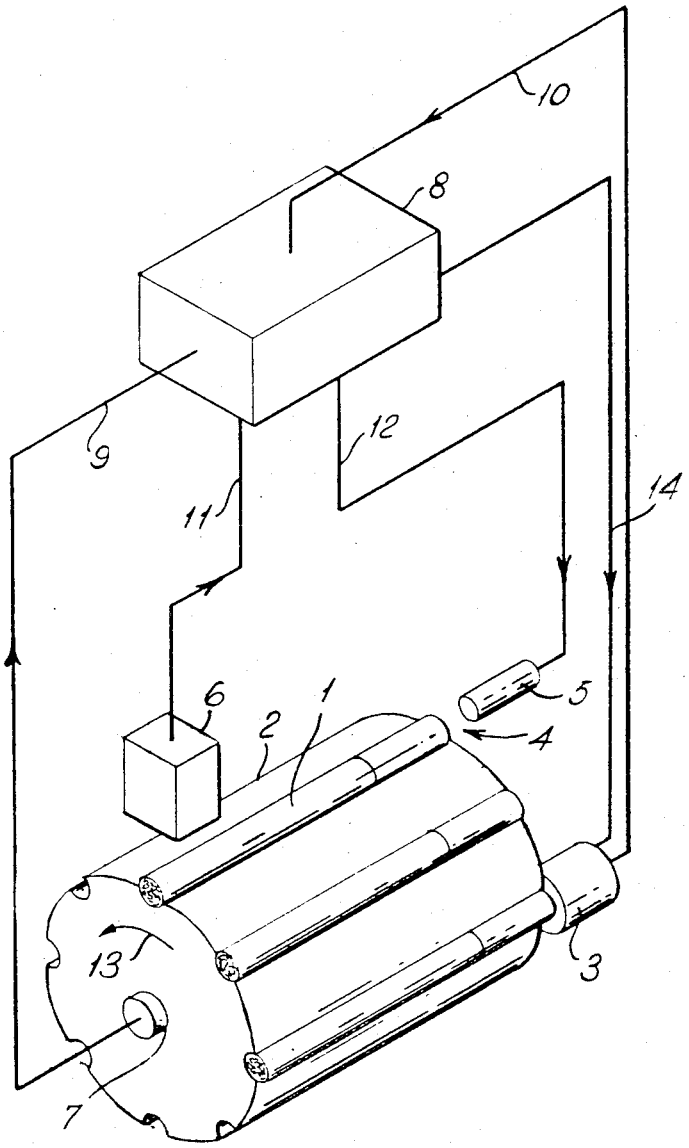
10
8
9
12
11
14
6
2
1
5
4
13
3
7

CIGARETTE MANUFACTURE

The present invention relates to the control of operations on cigarettes and other rods of the cigarette industry (e.g. cigarette filters) while they are being conveyed. For convenience, the invention will be described only in terms of cigarettes.

In the manufacture of cigarettes in a continuous production line many operations may be effected on the cigarettes e.g. tests to establish data, or rejection or further processing in dependence upon the established data.

Each operation or test must be performed only when a cigarette is present at the appropriate test or operating station along the production line. Thus they must be performed at specific points in time dependent upon the speed of the cigarettes along the production line. In addition there are real-time finite delays associated with each test or operating device which are independent of the cigarette speed. For example, in a pneumatic ejection device it takes time for compressed air to flow from a source through a duct to an ejection air nozzle. Also, in a pneumatic leak test there is a delay between suction being applied to the cigarette and the effect of the suction reaching a sensor. Hence the moment at which the sensor is to be scanned for the result of the test must be adjusted accordingly.

According to the present invention there is provided an arrangement for controlling the timing of control signals concerning operations on conveyed cigarettes (or other rods of the cigarette industry), comprising means for generating the control signals, means for measuring the speed of transport of the cigarettes, and processing means arranged to receive a signal representing the measured speed of transport and arranged to be preprogrammed with data indicative of the distance to be travelled by a conveyed cigarette between a control signal being generated and an associated operation being effected, and also with data indicative of the time delay between a control signal being released to an operating device, and an associated operation being effected, wherein the processing means is arranged to calculate from the received signals and the pre-programmed data the appropriate moment to release the control signals to ensure that the associated operation is effected with regard to the article for which it is intended.

The processing means may be a microprocessor.

The control signal may be a strobing signal for a pneumatic test sensor, the associated operation being to apply suction to a cigarette at the test station and the time delay that taken for the effect of the suction fully to reach the sensor. In another application the control signal may be generated by the test station as an indication that the cigarette is substandard and should be rejected. The operation is then a rejection operation and the delay is that taken for pressure to build up sufficiently for ejection to occur.

For a better understanding of the present invention and to show how the same may be carried into effect, reference will now be made, by way of example, to the accompanying drawing which shows the arrangement of the present invention in use as part of a cigarette machine.

The FIGURE shows cigarettes 1 carried in flutes of a fluted conveyor drum 2. Drum 2 rotates in a counter clockwise direction as indicated by arrow 13. The cigarettes pass through a cigarette inspection station 3 shown very schematically in FIG. 1. Inspection station 3 may be as described in British Pat. No. 1,217,203. The cigarettes 1 are pneumatically tested at station 3 for defects such as tears in the wrapper, and subsequently pass through an ejection station 4 where faulty cigarettes are ejected by ejection device 5 which may be a compressed air jet. A cigarette sensor 6 monitors the presence of a cigarette at the ejection station 4. The speed of transport of the cigarettes 1 is measured by tachometer 7 which monitors the movement of the drum 2.

A microprocessor represented at 8 receives a speed signal from the tachometer 7 via a line 9, control signals indicating defective cigarettes from inspection station 3 via line 10 and cigarette present signals from sensor 6 via line 11. The microprocessor releases control signals at appropriate times to inspection station 3 via line 14 and to the ejection device 5 via line 12.

It will be appreciated that the FIGURE is very schematic. In a cigarette inspection machine there will normally be several drums similar to drum 2 each having 20 or more cigarette flutes, and the inspection and rejection stations will be significantly further apart than shown in the FIGURE.

As cigarettes arrive at inspection station 3 suction is applied. Determination of the appropriate moment to apply a control signal to initiate the suction test may be made by the microprocessor, in a manner similar to that described below for initiation of ejection device 5. The microprocessor must also control the scanning of the pressure sensor at station 3 to determine the results of the test. The sensor will not be instantaneously responsive to a pressure change and a fixed interval must be observed before the microprocessor 8 releases a strobing signal on line 14 to station 3 to determine the results of the test. On receipt of the strobing signal, station 3 sends back to the microprocessor 8 on line 10 a control signal indicating a defective cigarette if this is the case. This control signal is in turn delayed appropriately by microprocessor 8 to activate ejector 5.

In order to calculate the appropriate time to release control signal received from the inspection station 3 to the ejection device 5 the microprocessor must take into account two time delay factors. The first is that an ejection operation in response to a control signal indicating that a faulty cigarette has been detected at inspection station 3 must not occur before the cigarette which gave rise to the fault control signal has reached the ejection station 4. The second factor is the response speed of the ejection device 5. Ejection of a cigarette will not occur simultaneously with the application of a control signal via line 12 to the ejection device 5. A finite time delay is inherent in the injection device 5; for example, if the ejection device 5 is pneumatic it will take a finite time for compressed air to flow along a duct of the ejection device 5 to the nozzle of device 5. This response speed of ejection device 5 is independent of the speed of conveyance of the articles whereas the first time factor is dependent upon conveyance speed.

The microprocessor therefore calculates, from the speed signal on line 9 and pre-programmed data indicating the distance between inspection station 3 and ejection station 4, the desired time delay between generation of a control signal and ejection of an article. It then subtracts from this desired time delay the pre-programmed response speed of ejection device 5 and uses the result to release the control signal to the ejection device 5 at an appropriate time. The microprocessor also takes into account the cigarette present signal on line 11 from cigarette sensor 6. Hence no control signal will be released on line 12 unless a cigarette is present at ejection station 4. The cigarette sensor 6 may be a light sensor or a magnetic sensor. It may be placed at other positions around the drum and the microprocessor programmed accordingly to recognise empty flutes.

The response speed of the ejection device 5, which is pre-programmed in the microprocessor 8, must be ascertained from tests conducted prior to full scale use of the arrangement. Usually such response time is easily found or is well known.

Cigarette inspection at inspection station 3 may be carried out using a Molins' CID 4 or CID 6. These are pneumatic devices which test the resistance to air flow through successive cigarettes to detect any cigarettes which are defective, for example have a torn wrapper. The cigarette inspection station 3 may be further spaced from the ejection station 4, for example they may be on separate drums.

An arrangement according to the present invention may be used for controlling the timing of control signals effecting other operations. For example, when ventilation cigarettes are being tested at inspection station 3 a control signal may be generated to indicate that a particular cigarette requires further perforations to make it acceptable, such extra perforation may be effected at a perforating station downstream of the inspection device under control of a control signal which has been appropriately delayed by the microprocessor in accordance with the invention. An arrangement according to the present invention may also be used for example on a cigarette making machine where control signals are generated to indicate that a further operation must be performed on a particular cigarette. The invention also finds applications in the production line manufacture of articles other than cigarettes.

The microprocessor 8 may be used for various other control and information display functions in the cigarette making machine. It will be understood that it has the necessary interfaces and memory for perforing these various functions.

In the attached claims reference will for convenience be made to cigarettes, but it is to be understood that the term "cigarette" in this context is intended to include other rods of the cigarette industry, for example filters.

I claim:

1. Apparatus for controlling the timing of control signals concerning operations on conveyed cigarettes comprising means for generating the control signals, means for measuring the speed of transport of the cigarettes, and processing means arranged to receive from said measuring means a signal representing the measured speed of transport and arranged to be pre-programmed with data indicative of the distance to be travelled by a conveyed cigarette between a position occupied by the cigarette when a control signal is generated and a position to be occupied by the same cigarette when an associated operation is effected, and also with data indicative of the time delay between a control signal being released to an operating device and an associated operation being effected, wherein the processing means includes means for calculating from the received signals and the pre-programmed data the appropriate moment to release the control signals to ensure that the associated operation is effected with regard to the article for which it is intended.

2. Apparatus for controlling the timing of control signals concerning operations on conveyed cigarettes or other articles of the cigarette industry comprising means for generating a first control signal; means for measuring the speed of transport of the cigarettes; processing means arranged to receive from said speed measuring means a signal representing the measured speed of transport and to receive said first control signal for generating a second control signal which is transmitted to an operating device after a delay dependent upon the signal representing the measured speed of transport and upon the characteristics and position of the operating device.

3. Apparatus according to claim 2 in which said first control signal represents the arrival of a cigarette in a pneumatic testing station for detecting a fault in the cigarette, and second control signal is a strobe signal for recording at the appropriate instant the pressure indicated by a pressure detector associated with the test station.

4. Apparatus according to claim 2 in which said first control signal represents the result of a test carried out on the cigarette to detect a fault, and said second control signal is a signal required to initiate said rejection of a cigarette failing the test.

5. Apparatus according to claim 2 in which the control signal represents the result of a test carried out on the cigarette to determine the ventilation of the cigarette and the second control signal is that required to perforate the wrapper of the cigarette to bring the ventilation of the cigarette to a predetermined level.

6. Apparatus according to claim 5 in which said processing means comprises a microprocessor with an interface device and memory means for storing data upon which the delay before production of said second control signal is dependent and data relating to the predetermined level of ventilation desired for each cigarette, and further including means responsive to said microprocessor for controlling the perforation of the wrappers of said cigarettes.

7. Apparatus according to claim 2 in which said first control signal is obtained from a device associated with a cigarette making machine and said second control signal is used to control a process downstream of said device in the cigarette making machine.

8. Apparatus according to any one of claims 2 to 7 in which said processing means comprises a microprocessor with associated interfaces and a memory containing data upon which the delay before production of said second control signal is dependent.

* * * * *